US006988330B2

(12) United States Patent
Gavronsky

(10) Patent No.: US 6,988,330 B2
(45) Date of Patent: Jan. 24, 2006

(54) CALENDAR SLIDE

(75) Inventor: Allan Gavronsky, Cincinnati, OH (US)

(73) Assignee: Stuebing Automatic Machine Co., Cincinnati, OH (US)

( * ) Notice: Subject to any disclaimer, the term of this patent is extended or adjusted under 35 U.S.C. 154(b) by 67 days.

(21) Appl. No.: 10/369,408

(22) Filed: Feb. 18, 2003

(65) Prior Publication Data

US 2004/0111928 A1 Jun. 17, 2004

Related U.S. Application Data

(63) Continuation-in-part of application No. 10/321,413, filed on Dec. 17, 2002, now abandoned.

(51) Int. Cl.
*G09D 3/00* (2006.01)

(52) U.S. Cl. ..... 40/107; 40/372

(58) Field of Classification Search ..... 40/107, 40/372, 382; 24/561, 67.11
See application file for complete search history.

(56) References Cited

U.S. PATENT DOCUMENTS

| | | | | |
|---|---|---|---|---|
| 1,906,024 A | | 4/1933 | Todd | |
| 2,042,912 A | | 6/1936 | Stuebing, Jr. | |
| 2,568,373 A | * | 9/1951 | Sweet | 72/185 |
| 3,023,474 A | | 3/1962 | Shears | |
| 3,838,530 A | | 10/1974 | Schelling, Jr. | 40/107 |
| 4,105,127 A | | 8/1978 | Holl | |
| 4,245,415 A | * | 1/1981 | Spees | 40/380 |
| 4,899,974 A | | 2/1990 | Wear et al. | |
| 5,112,083 A | | 5/1992 | Morrone | |
| 5,309,181 A | | 5/1994 | Ota et al. | |
| D354,986 S | | 1/1995 | Chu | |
| 5,390,889 A | | 2/1995 | Hiscock | |
| 5,707,194 A | | 1/1998 | Blumberg et al. | |
| 5,730,571 A | | 3/1998 | Rinaudo | |
| 6,018,849 A | | 2/2000 | Royer | |
| 6,042,319 A | | 3/2000 | Hoffman | |
| 6,182,938 B1 | | 2/2001 | Wright | |
| 6,698,988 B2 | | 3/2004 | Hoffman | |

* cited by examiner

*Primary Examiner*—Joanne Silbermann
(74) *Attorney, Agent, or Firm*—Wood, Herron & Evans, LLP

(57) ABSTRACT

A calendar slide for binding a margin of a calendar or a poster and allowing the same to be hung by a hanger in a desired location, such as a wall. Spaced convex bulges in the calendar slide prevent the slides from sticking together during the storage, shipment, and binding processes, and also promote uniform stacking of the slides in a tinning machine magazine, and finally prevent the adjacent nested slides from scratching or marring one another.

42 Claims, 4 Drawing Sheets

CALENDAR SLIDE

This is a continuation-in-part of U.S. patent application Ser. No. 10/321,413 filed Dec. 17, 2002 now abandoned and hereby incorporated by reference in its entirety.

FIELD OF THE INVENTION

This invention relates to document binders. More specifically, this invention relates to the art of binding calendars, posters, documents, and banners with a binding strip and a method for making the same.

BACKGROUND OF THE INVENTION

Slides for binding a margin of a calendar, poster, document, banner, or other wall hanging are known in the art. Examples of prior art slides are shown in FIGS. 1–4, and such a slide 1 is generally an elongated strip of roughly V-shaped sheet metal. The vertex 2 of the elongated V-shaped strip of sheet metal separates the two sides or legs 3,4 of the V-shaped strip. Typically, one side or leg 3 of the V-shaped strip is shorter or narrower, and the other side or leg 4 is longer or wider. The slide 1 also typically contains a hanger 5 which, as shown in FIG. 1, is a separate piece attached to the V-shaped sheet metal strip or, as shown in FIG. 2, is part of the V-shaped sheet metal strip. The hanger 5, shown in FIG. 1, is typically made out of plastic and is staked or attached at the approximate longitudinal center of the metal strip by one or more sheet metal burrs or rivets 6. The V-shaped strip of sheet metal is attached to a calendar by folding or crimping it onto the margin of the calendar. The hanger 5 can then be used to hang and display the calendar at a desired location, e.g., a wall. The surface of the slide that is visible when it is displayed is often painted to prevent oxidization and for aesthetic purposes. Examples of slides are shown in U.S. Pat. Nos. 1,906,024; 2,042,912; and 6,042,319, each of which are hereby incorporated by reference.

The prior art also discloses an old version of a slide that includes two indentations in the longer, wider side or leg 4 of the V-shaped sheet metal strip, as shown in U.S. Pat. No. 2,042,912. The indentations in the slide disclosed in that patent project outwardly, away from the associated leg 3 and are close to the ends of the slide.

There are a number of problems with these prior art slides. First, the slides have a tendency to stick together when they are stacked or nested tightly together. This is particularly problematic when a binding or tinning machine is being used to install a slide on a calendar.

Traditionally, an operator manually attached a slide to the margin of a calendar, one slide at a time, using a tinning machine. Accordingly, while stuck-together slides could be an annoyance, and could take extra time to separate, an operator could at least see the problem and separate the slides. More recently, however, newer binding or tinning machines have been developed with magazines or hoppers which hold a supply of the slides nested together. Accordingly, now when slides stick together, they not only become more difficult to feed from the magazine or hopper, but there is also an increased tendency for multiple stuck-together slides to be fed into the tinning station, causing the machine to jam or malfunction.

Another problem with the traditional slide is that, as shown in FIG. 3, when the slides are stacked or nested together, the attached hanger 5 and the associated rivets or burrs 6 tend to act as a fulcrum and, as the stack grows, cause one end of the slides to fan or bow out. This lack of stackable uniformity can increase the space required for shipping or storing the slides. In addition, when the slides fan, bend, bow, or curl, the capacity of the binding or tinning machine magazine or hopper is reduced. Decreasing the capacity of the tinning machine's magazine means that it must be more frequently refilled, thus decreasing the overall efficiency and productivity of the binding operation.

Additionally, when the slides shown in FIGS. 1 and 4 are stacked or nested together in a tinning machine magazine or in the case of shipment or storage, the protruding indentations, bulges, burrs or rivets 6, which often have rough edges, can scratch the painted exterior of an adjacent slide, causing unsightly marks and contributing to either a less than desirable end product, or a product that must be discarded due to quality control standards. For example, if the concave indentations are placed, as shown in the prior art '912 patent, near to the longitudinal ends, the slide will have a tendency to medially sag, bend, or bow. Thus, this has the undesirable effect of creating a nonuniform stack of slides which results in a decreased tinning machine magazine capacity, increased difficulty in feeding the slides from a magazine, and increased likelihood of feeding malfunctions. Moreover, when the longitudinal center sags, bends, or bows, there is an increased tendency for the burrs or rivets to contact and scratch or mar the painted or coated exterior of the second wider bend portion. Such scratching or marring, especially at the visible center, when displayed, of the slide may, based on quality control standards, require the slide to be discarded, or sold at a lower price.

Moreover, when a slide with concave indentations is used in a binding or tinning machine, the crimping bars of the binding machine move directly against the painted and protruding surface of the concave indentations and tend to scratch or remove the paint from such protrusions.

SUMMARY OF THE INVENTION

It is, therefore, an objective of the present invention to provide an improved slide that will not have a tendency to stick together when nested.

It is further an objective of the present invention to provide an improved slide that will maximize the capacity of the magazine of a binding or tinning machine.

It is another objective of the present invention to provide an improved slide which will have a reduced tendency toward scratching or marring when the slides are stacked or nested together or used in a tinning machine.

These and other objectives of the present invention are achieved with an improved slide. More specifically, in some embodiments of this invention, convex bulges are placed near the longitudinal ends of the slide and/or near the longitudinal center of the slide. These convex bulges provide an air gap between adjacent slides, thus lessening the likelihood of multiple nested slides sticking together. The multiple convex bulges also serve to promote a uniform stacking of slides in a tinning machine's magazine or when stored or shipped. Finally, the convex bulges also provide a buffer between the protruding rivets or burrs of a hanger and the slides' painted or coated exterior, thus minimizing the possibility of scratches due to contact with adjacent slides.

BRIEF DESCRIPTION OF THE DRAWINGS

The objectives and features of the invention will become more readily apparent from the following detailed description taken in conjunction with the accompanying drawings in which.

DETAILED DESCRIPTION OF THE PREFERRED EMBODIMENT

Figure 1:
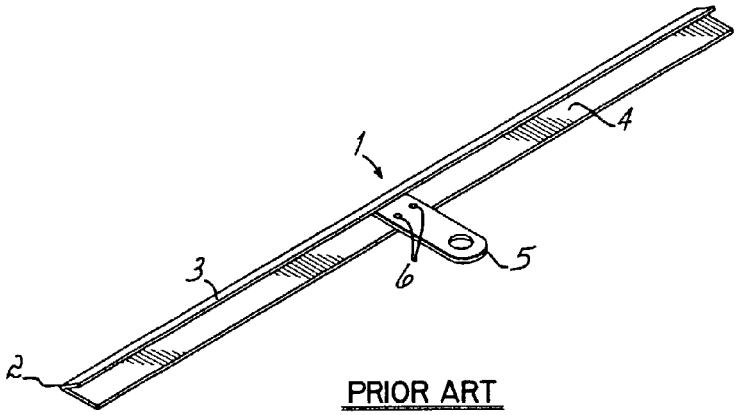
PRIOR ART FIG. 1
FIG. 1 is a perspective view of a first prior art calendar slide.
Figure 2:
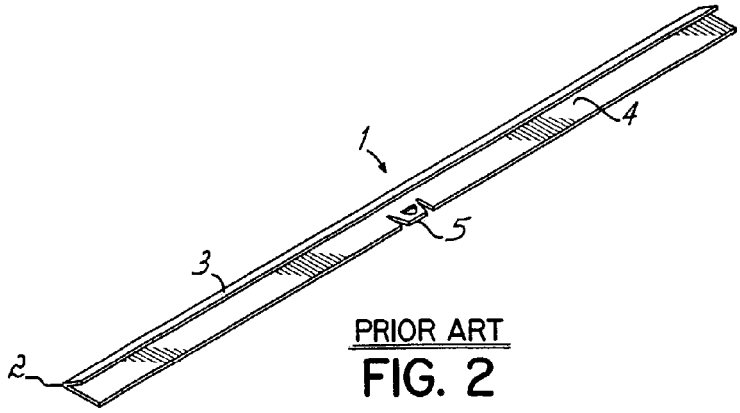
PRIOR ART FIG. 2
FIG. 2 is a perspective view of a second prior art calendar slide.
Figure 3:
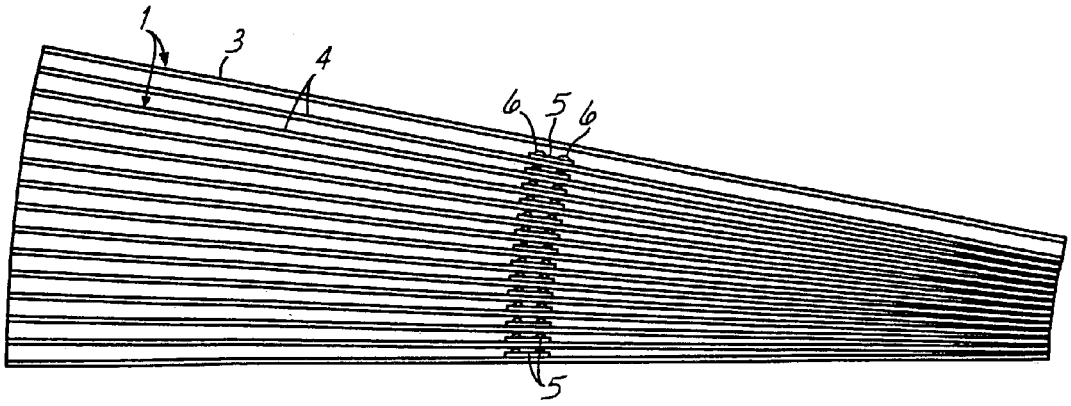
PRIOR ART FIG. 3
FIG. 3 is a front view of a plurality of calendar slides of FIG. 1 with the hangers and rivets acting as a fulcrum to fan out the calendar slides.
Figure 4:
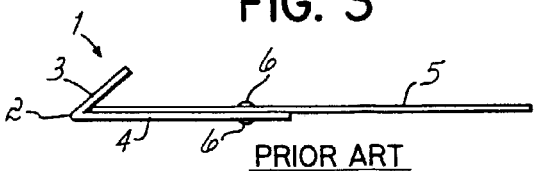
PRIOR ART FIG. 4
FIG. 4 is an end view of a prior art calendar slide, such as shown in FIG. 1, with a hanger attached with a rivet.

Presently preferred embodiments of the present inventive slide 10 are seen in FIGS. 5 through 11. It will be understood by those in the art that, while the present invention may be described as a calendar slide 10, the slide 10 may be used to bind and hang or display any other desired display item, such as a poster, document, banner, wall hanging, or workpiece 12.

The calendar slide 10 is typically made from a strip of sheet metal, although other substances with similar characteristics could be used. The typical sheet metal used is a cold rolled mild steel plate with a thickness of approximately 0.0062 inches; however, other types and/or sizes of metal could also be used. The sheet metal is bent to form longitudinal bend 14, which creates a generally V-shaped channel from the sheet metal strip. The longitudinal bend 14 in the sheet metal channel separates a first bend portion or leg 16 and a wider second bend portion or leg 18. According to one embodiment, the width of the first bend portion 16 is approximately 0.150 inches and the width of the second wider bend portion 18 is approximately 0.660 inches. These relative dimensions, while typical for usual application, could be proportionally or non-proportionally altered for special applications, such as an unusually large or heavy calendar or other display item 12. Similarly, while the slide 10 will normally have different size bend portions or legs 16, 18, a slide with generally the same size bend portions or legs 16, 18 may be used for unique applications, such as where a thicker installed slide 10 is desired or where a sheet metal fold is preferable to contact the fold in the calendar or other display item 12 when installed. The angular separation $\propto$ of the first bend portion 16 and the wider second bend portion 18 is approximately 38 degrees, although a greater or lesser degree of initial, angular separation could be used for particular applications. Each bend portion 16, 18 has respective interior surfaces 20, 22 and respective exterior surfaces 24, 26. The exterior surfaces 24, 26 of the respective bend portions 16, 18 are normally coated, e.g., with paint, to prevent oxidization and/or to achieve a desired aesthetic effect.

Figure 5:
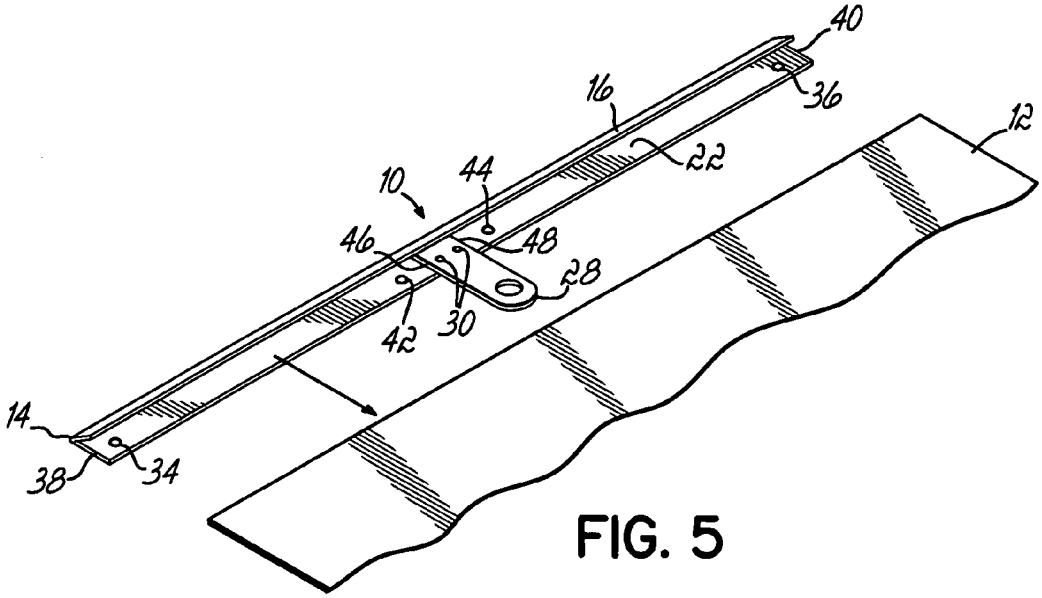
FIG. 5 is a perspective view of a first presently preferred embodiment of the present inventive slide prior to installation on a calendar or other planar display item.
Figure 5A:
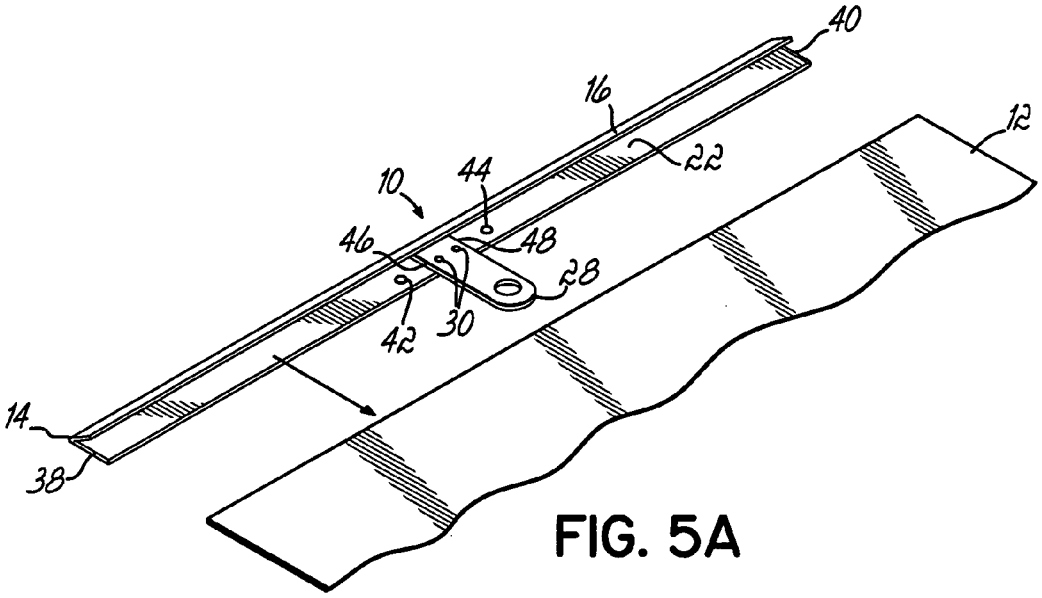
FIG. 5A is a view similar to FIG. 5 of another presently preferred embodiment of this invention.
Figure 6:
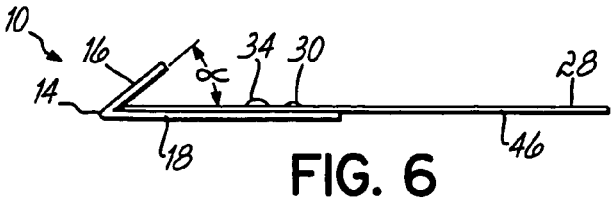
FIG. 6 is an end view of the slide of FIG. 5.
Figure 6A:
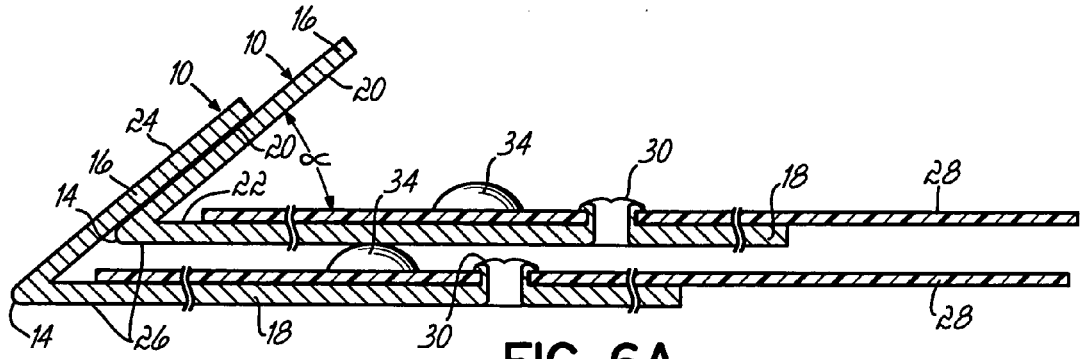
FIG. 6A is an enlarged cross-sectional view of two slides of FIG. 6 nested together.

In one embodiment, shown in FIGS. 5 and 5A, a hanger, tab, or eyelet 28 is attached to the longitudinal center of the interior surface 22 of the wider second bend portion 18 by a metal burr, rivet, glue, or other suitable fastener 30. While normally only one hanger 28 is utilized, and thus it is desirous for it to be medially positioned, when two or more hangers 28 are used, they are preferably proportionally spaced on the slide 10. Moreover, the hanger 28 could, if desired, be attached to other parts of the slide 10, for example, the exterior surface 26 of the wider second bend portion 18. In another alternative embodiments shown in FIGS. 8 and 8A, the hanger 32 is cut or stamped out of the wider second bend portion 18. The slide 10 could also be used without a hanger 28, 32, such as when a slide 10 is desired to be attached to the bottom of a calendar or other display item 12 for weight or aesthetic purposes.

Figure 8:
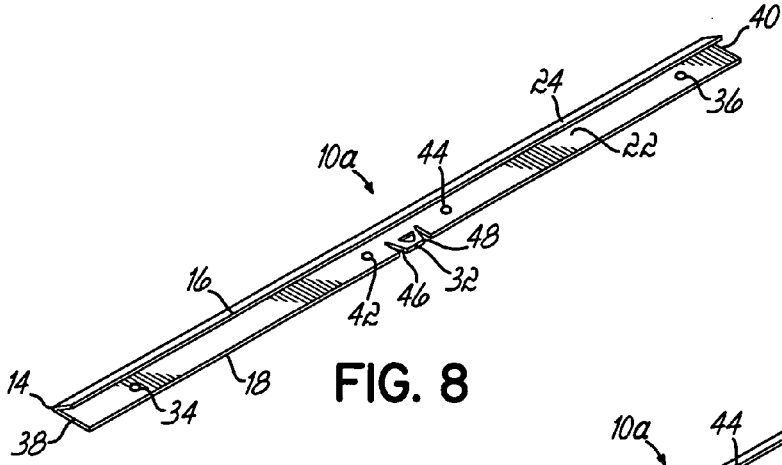
FIG. 8 is a perspective view of another embodiment of the present inventive slide.

Further, as shown in the embodiments of FIGS. 5 and 8, a pair of spaced convex bulges 34, 36 rise up, generally to a height of approximately 0.0200 inches, from the interior surface 22 of the wider second bend portion 18 toward the first bend portion 16. The height of the convex bulges 34, 36 could be adjusted in view of the thickness of the hanger 28 and/or the thickness of the burr, rivet, or other fastener 30. These convex bulges 34, 36 are generally laterally centered on the interior surface 22 of the second bend portion 18 and are also positioned relatively near to, and at a distance generally equal from, the respective longitudinal ends 38, 40 of the slide 10.

According to the embodiments of FIGS. 5 and 8, a second pair of spaced convex bulges 42, 44 also rise up from the interior surface 22 of the wider second bend portion 18 toward the first bend portion 16. These convex bulges 42, 44 are typically positioned near to the center of the slide 10 and at a distance generally equal from, the opposing side edges 46, 48 of the hanger 28, 32. For longitudinally short slides 10, or in other cases, it is possible that other configurations of convex bulges will be required to achieve the inventive purposes herein described. Conversely, for longitudinally long slides 10, or in other cases, it is possible that more than four spaced convex bulges will be required to achieve the inventive purposes herein described.

Figure 8A:
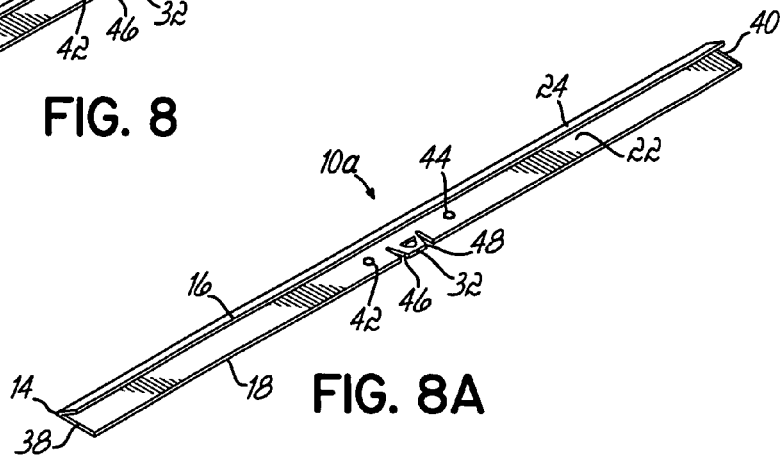
FIG. 8A is a view similar to FIG. 8 of another embodiment of the present invention.
Figure 9:
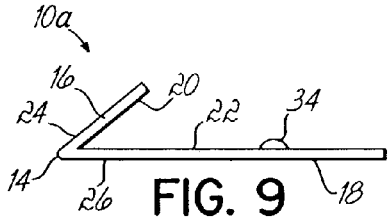
FIG. 9 is an end view of the slide of FIG. 8.

Referring to FIGS. 5A and 8A, still further alternative embodiments of the slide 10, 10*a* according to this invention are shown. These slides 10, 10*a* do not have the bulges 34, 36 proximate the longitudinal ends 38, 40, but do include the bulges 42, 44 centrally located on the slide 10, 10*a*. Moreover, while the bulges 42, 44 are shown as convex, they could readily be concave or another shape/configuration.

The calendar slide 10, 10*a* herein described, disclosed, and claimed, can be made by longitudinally bending a sheet metal strip into a generally V-shaped workpiece having the longitudinal bend 14 extending from the longitudinal ends 38, 40 of the sheet metal strip. The bending of the sheet metal strip creates the first bend portion 16 and the wider second bend portion 18. While the sheet metal strip is normally pre-painted or coated, if such is not the case, an additional step of painting or coating at least the exterior surface 24, 26 of the sheet metal strip may be accomplished. Further, the method for making the inventive slide 10, 10A is further achieved by forming a plurality of spaced bulges on the interior surface 20, 22 of one of the bend portions 16, 18. One method to accomplish this is to impress one or more spaced concave dimples on the exterior surface 26 of the second wider bend portion 18 which, in turn, form spaced convex bulges 34, 36, 42, 44 on the interior surface 22 of the wider second bend portion 18. If the hanger 28 is desired, the process also includes the step of attaching the hanger 18 on the generally longitudinal center of the interior surface 22 of the wider second bend portion 18 by means of the fastener 30. Alternately, the process of making the slide 10 can include the step of cutting or stamping the hanger 32 in the generally longitudinal center of the wider second bend portion 18.

Figure 7:
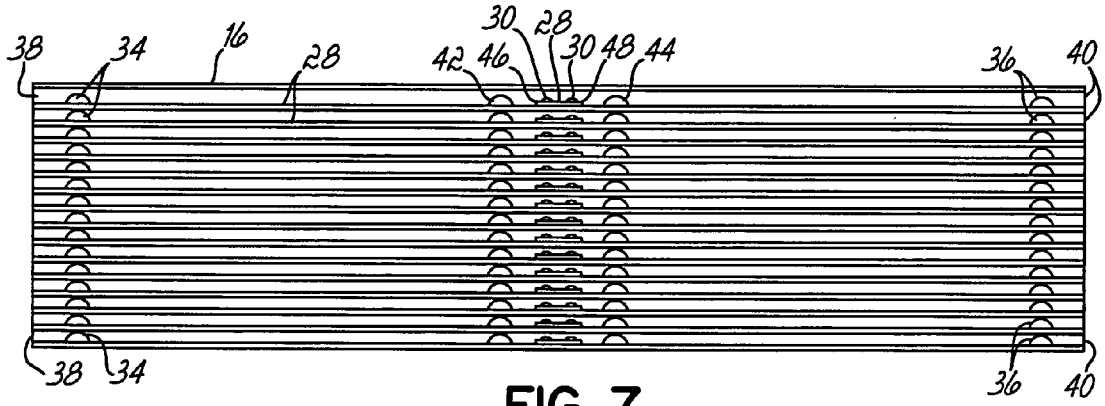
FIG. 7 is a front view of a plurality of slides, according to this invention, stacked on top of one another.
Figure 10:
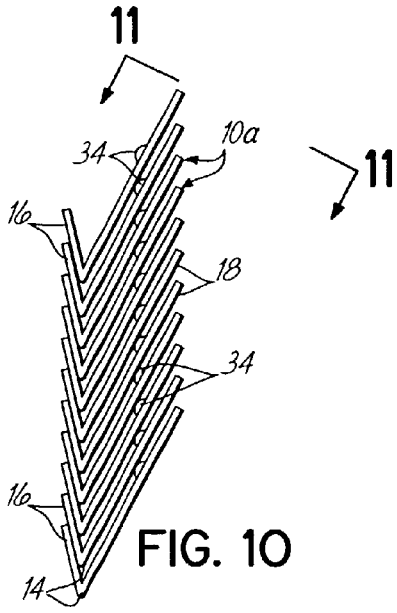
FIG. 10 is an end view of the slides of FIGS. 8 and 9 nested and stacked upon one another.
Figure 11:
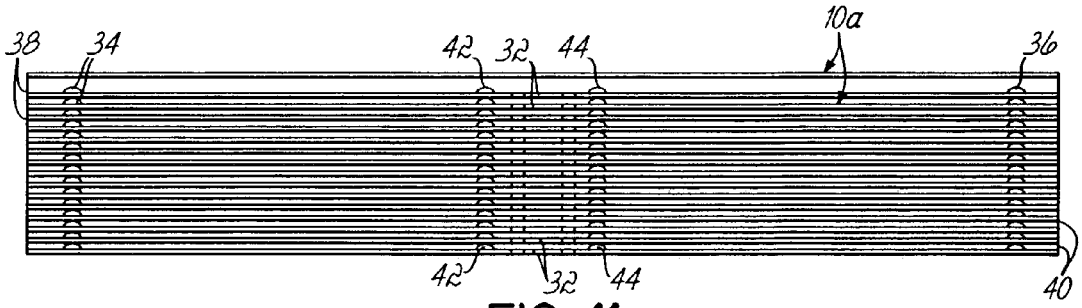
FIG. 11 is a front view of the calendar slides taken on lines 11—11 of FIG. 10.

The bulges 34, 36, 42, 44, individually and collectively, serve a number of important functions. First, they prevent the slides 10, 10*a* from sticking together when nested together, as is shown in FIG. 10. Second, the spaced convex bulges 34, 36, 42, 44 provide that the slides 10 will uniformly lie, as shown in FIGS. 7 and 11, in a stack or tinning machine magazine. A uniform stack of slides 10, 10*a* in a magazine or hopper will increase the slide 10, 10*a* capacity of the magazine and will also reduce the likelihood of a misfed slide which can jam the tinning machine. Similarly, a uniform stack of slides 10, 10*a* promotes more efficient storage and transportation of the slides 10, 10*a*, since less space per slide 10, 10*a* is required. These improvements contribute to increasing efficiency and productivity and thus lower costs. Finally, the spaced convex bulges 34, 36, 42, 44 prevent the rough edges of the burrs or rivets 30 from scratching or marring an adjacent slide 10 when the slides 10 are nested or stacked together. This improves the overall quality of the end product, thus again saving the expense of rejected items.

Further, the spaced convex bulges 34, 36, 42, 44 provide significant advantages over the pair of concave indentations shown in the prior art, i.e., U.S. Pat. No. 2,042,912. First, a single pair of concave indentations positioned near the respective lateral ends of the slide, as in the '912 patent, is generally unsuitable to prevent the nonuniform stacking of slides 10. For example, if the concave indentations are placed, as shown in the prior art '912 patent, near to the longitudinal ends 38, 40 of the slide 10, the slide 10 will have a tendency to medially sag, bend, or bow. Thus, this has the undesirable effect of creating a nonuniform stack of slides which results in a decreased tinning machine magazine capacity, increased difficulty in feeding the slides from a magazine, and increased likelihood of feeding malfunctions. Moreover, when the longitudinal center sags, bends, or bows, there is an increased tendency for the burrs or rivets 30 to contact and scratch or mar the painted or coated exterior 26 of the second wider bend portion 18. Such scratching or marring, especially at the visible center, when displayed, of the slide 10 may, based on quality control standards, require the slide 10 to be discarded, or sold at a lower price.

Moreover, when a slide with concave indentations is used in a binding or tinning machine, the crimping bars of the binding machine move directly against the painted and protruding surface of the concave indentations and tend to scratch or remove the paint from such protrusions. In contrast, the use of spaced convex bulges 34, 36, 42, 44, the painted exterior surface 26 of which is a depression, is not susceptible to the marring or scratching by a crimping bar of a binding or tinning machine. Moreover, a depression or dimple in the exterior painted surface 26 formed by the spaced convex bulges 34, 36, 42, 44 in the second wider bend portion 18 can be aesthetically more desirable than a pair of bumps or knobs on an otherwise smooth external surface 26. Finally, the protrusions of the spaced convex bulges 34, 36, 42, 44, which contact the item being hung, i.e., the calendar paper, poster board, etc., tend to provide the additional benefit of increasing the ability of the slide 10, 10*a* to grab, hold, and secure the item 12 sought to be attached to the slide 10, 10*a* and displayed.

While the spaced convex bulges 34, 36, 42, 44 serve an important function, it can also be appreciated by those skilled in the art that another suitable means could be used instead of, or along with, the bulges without detracting from the present invention. For example, a combination of convex and concave bulges, the use of a different channel material, a protective coating, or a disposable separator, such as a strip of paper, foam, cardboard, etc., could prevent adjacent channels from scratching each other when the channels are nested together, could prevent the channels from sticking together when nested, and could prevent nonuniform stacking of nested longitudinal channels.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

What is claimed is:

1. A slide for attaching to a display item comprising:

a longitudinal channel with a first end and second end and a longitudinal bend extending from the first end to the second end, the longitudinal bend joining a first bend portion and a second bend portion, the first and second bend portions each having respective interior confronting surfaces adapted to receive an edge of the display item there between and respective exterior surfaces;

a first set of bulges projecting from the interior surface of one of the bend portions toward the interior surface of the other bend portion, wherein all of the bulges on the slide have substantially the same height; and a hanger positioned on the channel wherein the bulges are spaced from the hanger.

2. The slide of claim 1 wherein the channel is comprised of metal.

3. The slide of claim 2 wherein the exterior surfaces of the first and second bend portions are coated.

4. The slide of claim 1 wherein the channel is generally V-shaped.

5. The slide of claim 1 wherein the second bend portion is wider than the first bend portion.

6. The slide of claim 1 wherein the first set of bulges further comprises two spaced convex bulges.

7. The slide of claim 6 wherein the first set of two convex bulges are proximate to and generally equally spaced from the first and second ends, respectively.

8. The slide of claim 7 further comprising:

a second set of at least one bulge projecting from the interior surface of one of the bend portions.

9. The slide of claim 8 wherein the second set of bulges is generally medially positioned on the channel.

10. The slide of claim 8 wherein the second set of bulges comprises a pair of convex bulges generally equally spaced from a longitudinal center of the channel.

11. The slide of claim 8 wherein the first and second sets of bulges both project from the same bend portion.

12. The slide of claim 1 wherein the hanger is generally centrally positioned on the channel.

13. The slide of claim 1 wherein the hanger is positioned on the second bend portion.

14. The slide of claim 1 wherein the hanger is positioned on the interior surface of the second bend portion.

15. The slide of claim 1, wherein the hanger is comprised of plastic.

16. The slide of claim 1 further comprising:

a fastener coupling the hanger to the channel;

wherein the bulges project further from the interior surface of the bend portion than the fastener.

17. The slide of claim 1 wherein the first set of bulges is generally medially positioned on the channel.

18. The slide of claim 1 wherein the first set of bulges is on the second bend portion.

19. A slide for attaching to a display item comprising:

a longitudinal channel with a first end and second end and a longitudinal bend extending from the first end to the second end, the longitudinal bend joining a first bend portion and a second bend portion, the first and second bend portions each having respective interior confronting surfaces adapted to receive an edge of the display item there between and respective exterior surfaces;

a first set of bulges projecting from one of the bend portions and positioned generally medially on the channel, wherein all of the bulges on the slide have substantially the same height; and a hanger positioned on the channel wherein the bulges are spaced from the hanger.

20. The slide of claim 19 wherein the first set of bulges further comprises two spaced convex bulges.

21. The slide of claim 20 wherein the first set of bulges project from the interior surface of one of the bend portions toward the interior surface of the other bend portion.

22. The slide of claim 19 wherein the first set of bulges is on the second bend portion.

23. The slide of claim 19 wherein the hanger is generally centrally positioned on the channel.

24. The slide of claim 19 wherein the hanger is positioned on the second bend portion.

25. The slide of claim 19 wherein the hanger is positioned on the interior surface of the second bend portion.

26. The slide of claim 19 wherein the hanger is comprised of plastic.

27. The slide of claim 19 further comprising:

a fastener coupling the hanger to the channel;

wherein the bulges project further from the interior surface of the bend portion than the fastener.

28. The slide of claim 19 further comprising:

a second set of at least one bulge projecting from the interior surface of one of the bend portions.

29. The slide of claim 28 wherein the second set of bulges are each positioned proximate one of the first and second ends, respectively.

30. A slide for attaching to a planar display item comprising:

a longitudinal generally V-shape sheet metal channel with a first end and a second end and a longitudinal bend extending from the first end to the second end, the longitudinal bend joining a first bend portion and a wider second bend portion, wherein the first and second bend portions have respective interior confronting surfaces adapted to receive an edge of the display item there between and respective exterior surfaces, wherein the respective exterior surfaces are coated;

a first pair of spaced convex bulges projecting from the interior surface of the wider second bend portion, wherein each convex bulge of the first pair of spaced convex bulges is positioned proximate to one of the ends;

a hanger generally longitudinally centered and positioned on the interior surface of the wider second bend portion; and a second pair of spaced convex bulges projecting from the interior surface of the wider second bend portion, wherein each convex bulge of the second pair of spaced convex bulges is positioned proximate to the hanger;

wherein all of the bulges on the slide have substantially the same height.

31. The slide of claim 30 further comprising:

a fastener coupling the hanger to the channel;

wherein the bulges each project further from the interior surface of the second bend portion than the fastener.

32. A method for making a slide for attaching to a display item comprising the steps of:

longitudinally bending a sheet metal strip into a generally V-shape channel having a longitudinal bend extending from the longitudinal ends of the sheet metal channel, the longitudinal bend joining a first bend portion and a wider second bend portion, wherein the first and second bend portions have respective interior surfaces and respective exterior surfaces, wherein the respective exterior surfaces are coated;

forming a plurality of spaced bulges on the interior surface of one of the bend portions, wherein all of the bulges on the slide have substantially the same height; and forming a hanger on the channel wherein the bulges are spaced from the hanger.

33. The method of claim 32 wherein forming the hanger further comprises the step of:

attaching the hanger on the generally longitudinal center of the interior surface of the wider second bend portion by means of a fastener;

wherein the bulges each project further from the interior surface of the respective bend portions than the fastener.

34. The method of claim 32 wherein forming the hanger further comprises the step of:

cutting a hanger in the generally longitudinal center of the wider second bend portion.

35. The method of claim 32 wherein forming the bulges further comprises:

indenting dimples on the exterior surface of the respective bend portions to thereby form the bulges on the associated interior surface.

36. The method of claim 32 wherein forming the bulges further comprises:

forming a first pair of bulges, each of which is proximate to a longitudinal center of the channel.

37. The method of claim 36 wherein forming the bulges further comprises:

forming a second pair of bulges, each of which is proximate to one of the ends.

38. A magazine of slides, each of which is used for attaching to a display item, the magazine comprising:

a plurality of similarly configured and oriented longitudinal channels, each with a first end and a second end and a longitudinal bend extending from the first end to the second end, the longitudinal bend further joining a first bend portion and a wider second bend portion, wherein the first and second bend portions have respective interior surfaces and respective exterior surfaces, wherein the respective exterior surfaces are coated;

wherein the plurality of channels are nested together with the exterior surfaces of the first and second bend portions of a first channel juxtaposed to the interior surfaces of the first and second bend portions, respectively, of an adjacent channel;

a plurality of bulges for preventing the adjacent channel from scratching the first channel when the channels are nested together, wherein all of the bulges on each slide have substantially the same height; and a means for hanging the longitudinal channel wherein the bulges are spaced from the means for hanging.

39. The magazine of slides of claim 38 wherein the slides further comprise a means for preventing the longitudinal channel from sticking to another longitudinal channel when the longitudinal channels are nested together.

40. The magazine of slides of claim 38 wherein the slides further comprise a means for preventing nonuniform stacking of nested longitudinal channels.

41. A magazine of slides, each of which is used for attaching to a display item, the magazine comprising:

a plurality of similarly configured and oriented longitudinal channels, each with a first end and a second end and a longitudinal bend extending from the first end to the second end, the longitudinal bend further joining a first bend portion and a second bend portion, wherein the first and second bend portions have respective interior surfaces and respective exterior surfaces, each channel further including a first set of bulges projecting from the interior surface of one of the first and second bend portions toward the interior surface of the other one of the first and second bend portions;

wherein the plurality of channels are nested together with the exterior surfaces of the first and second bend portions of a first channel juxtaposed to the interior surfaces of the first and second bend portions, respectively, of an adjacent channel; and wherein the bulges on a selected channel are offset from the corresponding bulges on an adjacent channel in a direction generally perpendicular to one of the first and second bend portions; and a means for hanging the longitudinal channel.

42. The magazine of slides of claim 41 wherein all of the bulges on each slide have substantially the same height.

* * * * *